US006203018B1

(12) United States Patent
Osuch

(10) Patent No.: US 6,203,018 B1
(45) Date of Patent: Mar. 20, 2001

(54) CARD GAME AND METHOD OF PLAY

(76) Inventor: Andre Osuch, 654 Serramonte Blvd., Unit B, Daly City, CA (US) 94015

( * ) Notice: Subject to any disclaimer, the term of this patent is extended or adjusted under 35 U.S.C. 154(b) by 0 days.

(21) Appl. No.: 09/405,310

(22) Filed: Sep. 18, 1999

Related U.S. Application Data

(60) Provisional application No. 60/100,776, filed on Sep. 17, 1998.

(51) Int. Cl.[7] ..... A63F 1/00
(52) U.S. Cl. ..... 273/292
(58) Field of Search ..... 273/274, 292, 273/303; 463/12, 13

(56) References Cited

U.S. PATENT DOCUMENTS 5,494,295 * 2/1996 Potter .
5,573,249 * 11/1996 Johnson .
5,605,333 * 2/1997 Field .
5,810,354 * 9/1998 Banyai .
6,027,119 * 8/1998 De Lisle .

* cited by examiner

*Primary Examiner*—Benjamin H. Layno
(74) *Attorney, Agent, or Firm*—Goldstein & Canino

(57) ABSTRACT

A card game and method of play that is comprised of a unique card game that substantially reverses the traditional rankings of poker, and is played by several players, including a banker/player. The best five card hand, that includes an eight or lower, is the winner, as determined by a hierarchy. According to the hierarchy, a low card straight flush of eight or lower beats a low card non-straight flush of eight or lower, which beats a low card non-suited straight, which beats a low card non-straight non-flush of eight or lower. Hands within each of these categories are superior if they have a lower highest card. If the highest cards are tied, then the second highest cards are compared, and so on. Each player attempts to beat the banker/player's hand.

5 Claims, No Drawings

CARD GAME AND METHOD OF PLAY

CROSS REFERRENCES AND RELATED SUBJECT MATTER

This application relates to subject matter contained in Provisional Patent Application Ser. No. 60/100,776, filed in the Patent and Trademark Office on Sep. 17, 1998.

BACKGROUND OF THE INVENTION

The present invention relates to a card game and method of play and more particularly pertains to providing a unique poker game that varies from normal poker games.

Standard card games, such as poker, have a predetermined hierarchy of winning hands. The highest hand is known as the royal flush, which is comprised of an ace, a king, a queen, a jack, and a ten, all of which are the same suit. Most poker games, such as draw and stud, utilize this hierarchy of winning hands to determine the winner of a particular game. Most poker players are continually seeking new games that will provide a variety to their games. The present invention is a game that will provide poker players with the variety that they seek. The present invention provides a unique hierarchy of winning hands that will cause players to have to change their strategy in order to become successful in the game. The main difference between the present invention and a five card draw poker game is that the traditional poker hand rankings are substantially reversed. The lowest five card hand, exposed at the showdown between active players and the banker/player, is the winner according to a predetermined hierarchy. According to this hierarchy each player tries to get the lowest five-card hand to beat the banker/player, wherein categorically, a straight flush in any face values 8 or lower combination is superior to flushes in any face values 8 or lower combination, which is superior to any face values 8 or lower non-flush straight, which is superior to any face values 8 or lower non-flush non-straight. Within each of these categories, generally the lower numeric value of the highest card in the hand will beat a similar hand with a higher high card. The supreme hand is a five card low straight flush in clubs, which is an automatic winner.

The use of card games is known in the prior art. More specifically, card games heretofore devised and utilized for the purpose of providing amusement are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a card game and method of play for providing a unique poker game that varies from normal poker games.

In this respect, the card game and method of play according to the present invention substantially departs from the conventional concepts and designs of the prior art, and in doing so provides an apparatus primarily developed for the purpose of providing a unique poker game that varies from normal poker games.

Therefore, it can be appreciated that there exists a continuing need for a new and improved card game and method of play which can be used for providing a unique poker game that varies from normal poker games. In this regard, the present invention substantially fulfills this need.

SUMMARY OF THE INVENTION

In the view of the foregoing disadvantages inherent in the known types of card games now present in the prior art, the present invention provides an improved card game and method of play. As such, the general purpose of the present invention, which will be described subsequently in greater detail, is to provide a new and improved card game and method of play and method which has all the advantages of the prior art and none of the disadvantages.

To attain this, the present invention essentially comprises a card game that reverses the traditional rankings of poker. The best five card hand, that includes an eight or lower, is the winner according to a predetermined hierarchy. Each player that is playing is attempting to beat the banker/player's hand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved card game and method of play which has all the advantages of the prior art card games and none of the disadvantages.

It is another object of the present invention to provide a new and improved card game and method of play which may be easily and efficiently marketed.

It is a further object of the present invention to provide a new and improved card game and method of play which is of durable and reliable construction.

Even still another object of the present invention is to provide a new and improved card game and method of play for providing a unique poker game that varies from normal poker games.

Lastly, it is an object of the present invention to provide a new and improved card game and method of play including a card game that reverses the traditional rankings of poker. The lowest five card hand, that includes an eight or lower, is the winner, according to the predetermined hierarchy. Each player that is playing is attempting to beat the banker/player's hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE PREFERRED EMBODIMENT

The preferred embodiment of the new and improved card game and method of play embodying the principles and concepts of the present invention will be described.

Specifically, it will be noted that the device relates to a card game and method of play for providing a unique poker game that varies from normal poker games.

The present invention is a two card draw, five card poker game where the best five card hand wins according to a predetermined hierarchy of categories, within each category the lowest cards generally prevail over higher cards. This game will be played with a standard deck of cards. The deck will consist of fifty-four cards including two Jokers. The Jokers will serve as wild cards, that is, they can become any card that the player holding the joker needs in order to make the best possible hand. But the joker cannot be used to duplicate a card which is already in the hand.

The game will preferably be played on a D-shaped table provided with seven sitting seats. Each seat will have six betting spots which have a spread limit, defining minimum and maximum amounts that may be wagered in the betting spots.

The game will be played with one voluntary banker player. Each banker/player can only serve two consecutive hands in such a role.

The game will be played with one action button. The action button will always start the new game from a first seat and will go in a clock-wise direction to a seventh seat. If the first seat is occupied by a banker/player, the action button will automatically move to a second seat.

The game will start with a shuffle procedure of the deck of cards, as determined by house rules. The dealer/banker will then ask each of the players to place a bet. Predetermined limits on betting can be established by the house. All bets must be made before the dealer distributes the cards. Each player is dealt five cards, one at a time, face down in front of the bet of each player. No player can touch or look at their cards at the time of delivery.

Any cards exposed by a player before the draw will play. If the dealer accidentally exposes one of the cards before the draw, during the dealing of the cards to the player, and that card is an eight or lower, that exposed card will play. If the card is higher than an eight, a replacement card will be provided. After the draw is completed, accidentally exposed cards will play, and no replacement cards will be allowed. After the cards have been dealt to all of the seats, then the seated players have a one time opportunity to look at their cards. The cards from any unoccupied seats will be collected by the dealer.

After looking at their cards, but before the draw, each of the players has the option to play of to fold and relinquish half of their bet or any other percentage of the bet as may be determined by house rules. The banker/player does not have this option.

If any of the players has a "Lucky Low" pat hand before the draw, which is comprised of the ace, two, three, four, and five of clubs, then that player is an automatic winner and is paid by the banker/player. If the banker/player has a "Lucky Low" pat hand before the draw, then all of the players lose to the banker/player.

If none of the players or the banker/player has a "Lucky Low" hand, then all of the players, including the dealer/banker, can discard at their option up to two cards and draw replacement cards. Of course they can choose to draw no cards, and "stay pat". However, the banker/player must stand on any pat 8 or lower, and has the option to stand on a pat 9, or to draw a card.

After the draw, the dealer will first expose the cards of the banker/player, and then the dealer will sequentially expose the cards of each of the players, wherein each player will be declared a winner if his hand is better than the banker/player's hand. The dealer will pay out to cover any winning hands and collect the bets from any losing hands. A new hand can then commence.

The hand rankings in the present invention are a low winning card hierarchy which is unique for determining the winning hands. A low card flush hand is the best hand—i.e. an "Ace", "2", "3", "4", "5" hand is superior. Any straight flush hand having an eight or lower as the high card beats any flush hand containing an eight or lower as the highest card, which in turn beats non-suited (not flush) straight, which in turn beats any non-flush (and non-straight) hand. Within one of these categories, generally a hand with a lower highest card will prevail. A tie between the highest card will then look to the next highest card, and so on. In the event of ties between numerically identical hands, suits will determine the winner based on the suit rankings. When necessary to determine an otherwise identical hand, the suits of the cards are ranked as follows: 1. Clubs, 2. Diamonds, 3. Hearts, 4. Spades. All flush hands containing non-paired cards and no card higher than an eight beat all non-flush hands regardless of the ranking of the individual cards. Non-flush straights headed by an eight or lower beat all non-straight hands. If the highest ranking card is a nine or greater in any hand, all flushes and straights are ignored. Any non-paired hand beats any pair. Any pair beats any three of a kind and so on.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A card game and method of play for a unique poker game having a different winning hand hierarchy from standard poker games comprising, for play by several players and a dealer in combination;

providing a standard deck of playing cards comprised of fifty-two cards and two jokers;

selecting a banker player from among the players;

providing a starting point for the playing cards to be distributed;

requiring each of the players to place a bet;

allowing dealer to distribute five cards to each of the seven seats;

allowing players and dealer to look at cards dealt to their respective seat;

determining if any of the players and dealer is an automatic winner by having a low card straight flush in clubs;

allowing each player to fold and relinquish a predetermined portion of their bet;

allowing all players who have not folded to choose to receive up to two new cards by relinquishing a same number of cards;

reading all of the player's cards and comparing with the cards of the banker/player to determine if any of the players are winners according to the card hierarchy, wherein the hierarchy dictates that straight flushes with all cards having a face value of no greater than eight categorically beat non-straight flushes of cards having a face value of no greater than eight which in turn categorically beat non-flush straights of cards having a face value of no greater than eight, which categorically beat non-straights non-flush hands of cards having a face value of no greater than eight, and wherein the heirarchy further dictates that within each of said categories a hand with a lower highest card will prevail;

requiring the dealer to match the bets of the players who were determined winners and requiring players who are determined losers to relinquish their bet to the dealer.

2. The card game as recited in 1, wherein within each category as recited, the winning hand has a lower highest card, and if the highest cards are tied, then a lower second highest card, and if the second highest cards are tied, then a lower third highest card, and if the third highest cards are tied, then a lower fourth highest card, and if the fourth highest card is tied, then a lower lowest card.

3. A card game and method of play for providing a poker game that varies from standard poker games with a low card winning hierarchy comprising, for play by a plurality of players and a dealer, in combination:

providing a standard deck of playing cards comprised of fifty-two cards and two jokers;

selecting a banker/player from one of the players;

distributing five cards to each of the players;

allowing players to look at cards dealt to their respective seat;

determining if any of the players is an automatic winner by having a low card straight flush of all clubs;

allowing players who have not folded to receive up to two new cards by relinquishing a same number of cards;

reading all of the player's cards and comparing with the cards of the banker player to determine if any of the players are winners by applying a low card winning hierarchy, wherein the hierarchy dictates that straight flushes with all cards having a face value of no greater than eight categorically beat non-straight flushes of cards having a face value of no greater than eight which in turn categorically beat non-flush straights of cards having a face value of no greater than eight, which categorically beat non-straights non-flush hands of cards having a face value of no greater than eight, and wherein the heirarchy further dictates that within each of said categories a hand with a lower highest card will prevail.

4. The card game as recited in claim 3, wherein the step of reading of the player's cards further comprises:

exposing the banker/players cards; and then sequentially exposing each of the other player's cards.

5. The card game as recited in 4, wherein within each category as recited, the winning hand has a lower highest card, and if the highest cards are tied, then a lower second highest card, and if the second highest cards are tied, then a lower third highest card, and if the third highest cards are tied, then a lower fourth highest card, and if the fourth highest card is tied, then a lower lowest card.

* * * * *